US010052901B1

(12) United States Patent
Norte

(10) Patent No.: US 10,052,901 B1
(45) Date of Patent: Aug. 21, 2018

(54) MULTI-PASS MICROWAVE DRYERS FOR PRINTING SYSTEMS

(71) Applicant: Andrew David Norte, Westminster, CO (US)

(72) Inventor: Andrew David Norte, Westminster, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/437,280

(22) Filed: Feb. 20, 2017

(51) Int. Cl.
*B41J 2/01* (2006.01)
*B41M 7/00* (2006.01)
*F26B 3/347* (2006.01)

(52) U.S. Cl.
CPC ..... *B41M 7/0081* (2013.01); *F26B 3/347* (2013.01)

(58) Field of Classification Search
None
See application file for complete search history.

(56) References Cited

U.S. PATENT DOCUMENTS 3,872,603 A * 3/1975 Williams ..... F26B 3/343 219/683
5,631,685 A * 5/1997 Gooray ..... B41J 11/002 101/488
5,757,407 A * 5/1998 Rezanka ..... B41J 11/002 347/102
6,246,037 B1 6/2001 Drozd et al.
6,663,239 B2 12/2003 Wotton et al.
6,888,115 B2 5/2005 Drozd
7,470,876 B2 12/2008 Drozd et al.
8,299,409 B2 10/2012 Harihara et al.
8,366,261 B2 2/2013 Yamada et al.
8,746,871 B2 6/2014 Chiwata
8,783,811 B2 7/2014 Nitta et al.
8,915,585 B1 12/2014 Ohara et al.
9,038,284 B2 5/2015 Feldman et al.
9,429,361 B2 8/2016 Harihara et al.
2011/0074864 A1* 3/2011 Yamada ..... B41J 11/002 347/20
2016/0144634 A1 5/2016 Emamjomeh et al.

FOREIGN PATENT DOCUMENTS

CN 103884163 B 2/2016

OTHER PUBLICATIONS

Frederick W Ahrens; Final Report; Application of a Device for Uniform Web Drying and Preheating Using Microwave Energy; dated Sep. 2003.
Hsuan-Ling Kao et al.; Inkjet-Printed Interdigital Coupled Line Filter on Liquid Crystal Polymer Substrate; IEEE Electron Device Letters, vol. 34, No. 12, Dec. 2013.

* cited by examiner

*Primary Examiner* — Erica Lin
(74) *Attorney, Agent, or Firm* — Duft Bornsen & Fettig LLP

(57) ABSTRACT

Microwave dryers that utilize multi-path and/or space saving configurations are disclosed. In a multi-path configuration, a print medium makes two or more passes through the passage(s) of microwave waveguide(s) in a microwave dryer, thereby increasing the exposure time of the print medium to electromagnetic energy within the waveguide(s). In a space saving configuration, the print medium takes a non-linear path through the microwave dryer, thereby reducing a footprint of the microwave dryer.

20 Claims, 5 Drawing Sheets

MULTI-PASS MICROWAVE DRYERS FOR PRINTING SYSTEMS

FIELD OF THE INVENTION

The invention relates to the field of printing systems, and in particular, to microwave dryers that are used to dry liquid materials that are applied to a print media by the printing system.

BACKGROUND

Production printing systems for high-volume printing typically utilize a production printer that marks a continuous-form print medium (e.g., paper) with a wet colorant (e.g., an aqueous ink). After marking the continuous-form print medium, a dryer downstream from the production printer is used to dry the colorant applied to the continuous-form print medium. Microwave dryers may be employed as a dryer for a production printing system in some applications.

A microwave dryer utilizes microwave energy to heat the colorant to cause a liquid portion of the colorant to evaporate, thereby fixing the colorant to the continuous-form print medium. A microwave source directs the microwave energy down a long axis of a waveguide, and a passageway through the waveguide is sized to enable the continuous-form print medium to pass through the waveguide. As the continuous-form print medium traverses the passageway, the wet colorants applied to the continuous-form print medium are exposed to the microwave energy and are heated.

Due to the high speeds used in production printing systems, the amount of time that a particular portion of the continuous-form print medium is within the passageway can be short. To ensure that the colorant can be dried, the length of the waveguides may be extended and/or the power of the microwave energy used to dry the colorant may be increased. However, long waveguides require more floor space in a production printing environment, and increasing the power of the microwave energy can add cost to the operation of the printing system.

SUMMARY

Microwave dryers that utilize multi-path and/or space saving configurations are disclosed. In a multi-path configuration, a print medium makes two or more passes through the passage(s) of microwave waveguide(s) in a microwave dryer, thereby increasing the exposure time of the print medium to electromagnetic energy within the waveguide(s). In a space saving configuration, the print medium takes a non-linear path through the microwave dryer, thereby reducing a footprint of the microwave dryer.

One embodiment comprises a microwave dryer that dries a wet colorant applied to a continuous-form print medium by a printing system. The microwave dryer includes a microwave source that generates electromagnetic energy to dry the wet colorant. The microwave dryer further includes a microwave waveguide coupled to the microwave source that transports the electromagnetic energy between a first end and a second end. The microwave waveguide includes a passageway that receives the continuous-form print medium at the first end and is sized to pass the continuous-form print medium through the microwave waveguide. The microwave dryer further includes a roller that is proximate to the second end that receives the continuous-form print medium from the passageway, and re-directs the continuous-form print medium back through the passageway to the first end.

Another embodiment comprises a microwave dryer that dries a wet colorant applied to a continuous-form print medium by a printing system. The microwave dryer includes a microwave source that generates electromagnetic energy to dry the wet colorant. The microwave dryer further includes a first microwave waveguide coupled to the microwave source that transports the electromagnetic energy between a first end and a second end of the first microwave waveguide, where the first microwave waveguide includes a first passageway that receives the continuous-form print medium at the first end and is sized to pass the continuous-form print medium through the first microwave waveguide to the second end. The microwave dryer further includes a second microwave waveguide that transports the electromagnetic energy between a third end and a fourth end of the second microwave waveguide, where the second microwave waveguide includes a second passageway that receives the continuous-form print medium at the third end and is sized to pass the continuous-form print medium through the second microwave waveguide to the fourth end. The microwave dryer further includes a bend coupler that is proximate to the second end of the first microwave waveguide and the third end of the second microwave waveguide that redirects the electromagnetic energy from the first microwave waveguide to the second microwave waveguide, where the bend coupler includes passages that are sized to pass the continuous-form print medium from the first passageway to the second passageway. The microwave dryer further includes a roller that is proximate to the passages of the bend coupler that redirects the continuous-form print medium from the first passageway of the first microwave waveguide to the second passageway of the second microwave waveguide.

Another embodiment comprises a printing system that includes a printer and a microwave dryer. The printer applies a wet colorant onto a continuous-form print medium. The microwave dryer receives the continuous-form print medium from the printer. The microwave dryer includes a microwave source that generates electromagnetic energy to dry the wet colorant and a microwave waveguide. The microwave waveguide is coupled to the microwave source and transports the electromagnetic energy between a first end and a second end, where the microwave waveguide includes a passageway that receives the continuous-form print medium at the first end and is sized to pass the continuous-form print medium through the microwave waveguide. The microwave dryer further includes a roller that is proximate to the second end that receives the continuous-form print medium from the passageway, and re-directs the continuous-form print medium back through the passageway to the first end.

Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DESCRIPTION OF THE EMBODIMENTS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
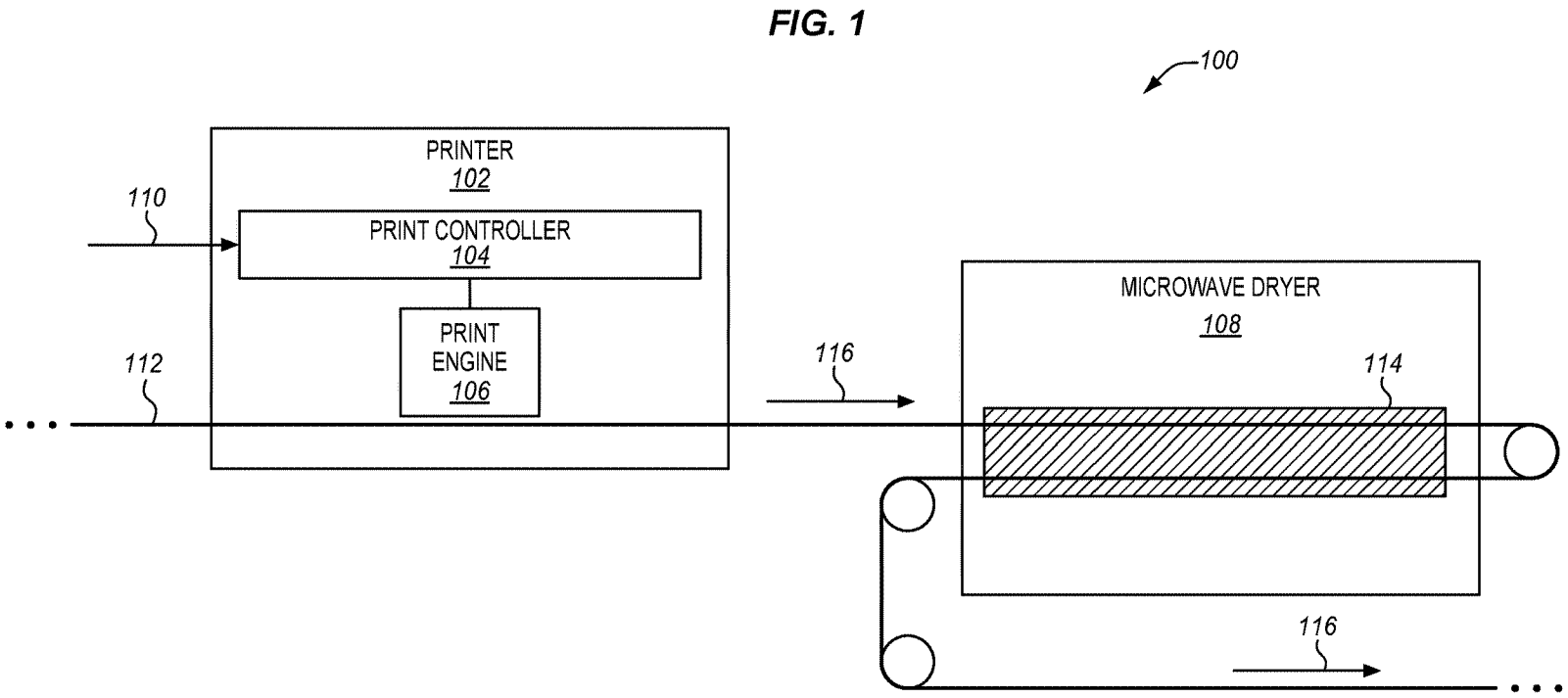
FIG. 1 is a block diagram of a printing system in an exemplary embodiment.

FIG. 1 is a block diagram of a printing system 100 in an exemplary embodiment. FIG. 1 also illustrates a print medium 112 (e.g., a continuous-form print medium or a cut-sheet print medium) that is marked by printing system 100 with a wet or liquid colorant. Some examples of wet or liquid colorants include aqueous inks. Some examples of print medium 112 include paper, textile, and other printable planar materials. Print medium 112 travels along a media path 116 in FIG. 1.

In this embodiment, printing system 100 includes a printer 102 and a microwave dryer 108. Printer 102 applies a wet colorant to print medium 112 (e.g., a continuous-form or cut-sheet media), which is then dried by microwave dryer 108. In printing system 100, a print controller 104 of printer 102 receives print data 110 for imprinting onto print medium 112, which is rasterized by print controller 104 into bitmap data. The bitmap data is used by a print engine 106 (e.g., a drop-on-demand print engine) of printer 102 to apply wet colorants to print medium 112, which then travels downstream of printer 102 to microwave dryer 108. Microwave dryer 108 applies electromagnetic energy 114 (e.g., microwave energy) to print medium 112, which heats the wet colorants applied to print medium 112 by electromagnetic heating (i.e., dielectric heating) to evaporate a liquid portion of the wet colorants. This fixes the wet colorants to print medium 112. Although printer 102 and microwave dryer 108 are illustrated as separate elements in FIG. 1, printer 102 and microwave dryer 108 may be combined together in some embodiments.

In high-speed production printing systems, the speed of the print medium through a microwave waveguide can make it difficult to maintain a sufficient exposure time of the print medium to the microwave energy without increasing the length of the microwave waveguide and/or increasing the amount of microwave power applied to the print medium by the microwave waveguide. However, increasing the length of the microwave waveguide increases the length of the microwave dryer, and increasing the microwave power applied to the print medium uses more electrical power.

In printing system 100, microwave dryer 108 utilizes a multi-path configuration to increase the exposure time of the wet colorants to electromagnetic energy 114. In a multi-path configuration, print medium 112 makes two or more passes through the passage(s) of the microwave waveguide(s) in microwave dryer 108, thereby increasing the exposure time of print medium 112 to electromagnetic energy 114. This allows the length of microwave dryer 108 to be reduced and/or the microwave power applied to print medium 112 to be reduced. Reducing the length of microwave dryer 108 may reduce the footprint of printing system 100 on a shop floor of a production printing facility. Reducing the microwave power used by microwave dryer 108 may reduce the operating costs of printing system 100.

Figure 2A:
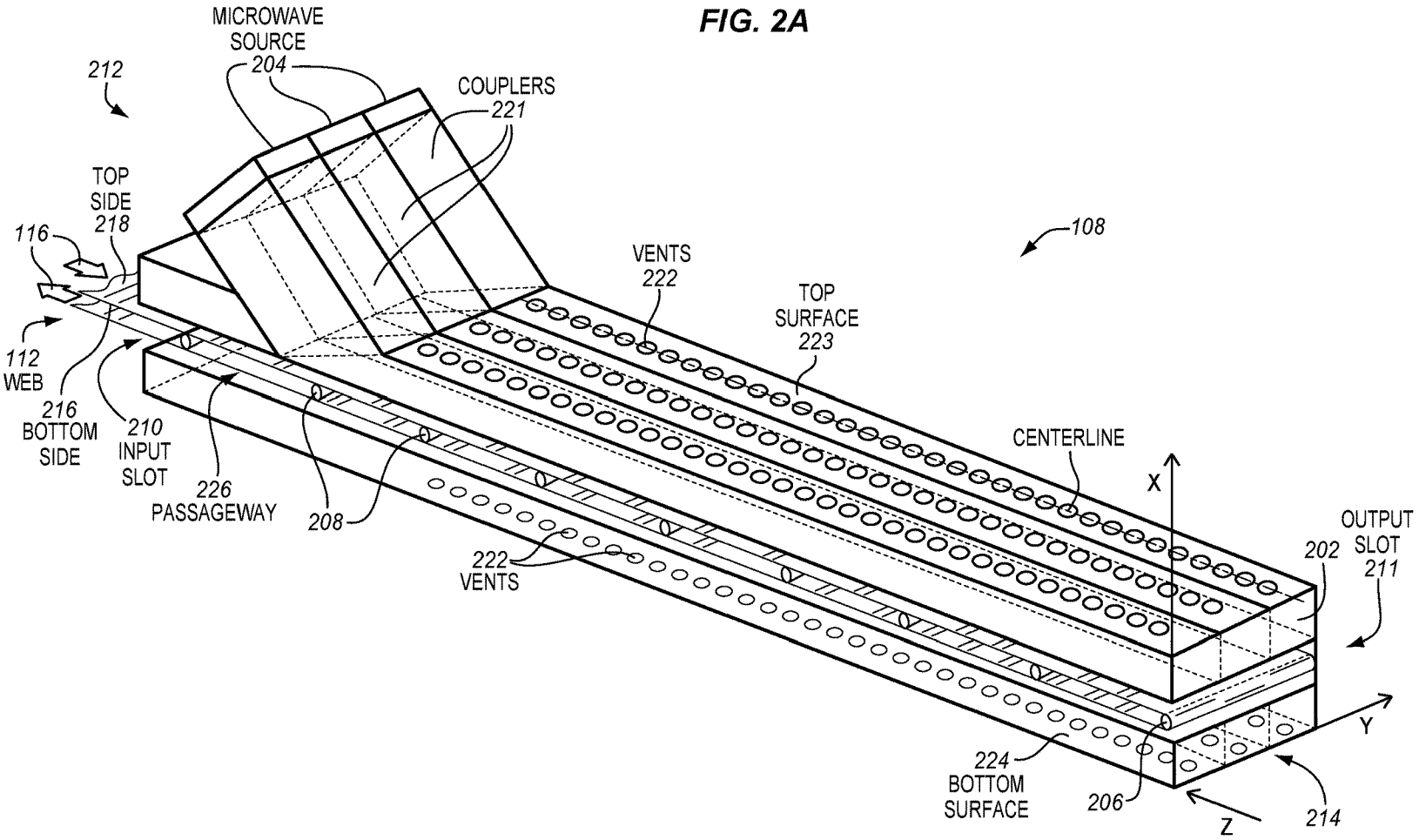
FIG. 2A is a 3-Dimensional cross-section of a microwave dryer in an exemplary embodiment.

FIG. 2A is a 3-Dimensional cross-section of microwave dryer 108 in an exemplary embodiment. In this embodiment, microwave dryer 108 includes a plurality of microwave waveguides 202 that are electromagnetically coupled to microwave sources 204 (e.g., a 2.4 Gigahertz microwave sources via couplers 221). Although waveguides 202 are illustrated in a horizontal configuration in FIG. 2, waveguides 202 may be oriented vertically within microwave dryer 108 to further reduce a horizontal footprint of microwave dryer 108. In this embodiment, microwave sources 204 inject electromagnetic energy 114 into waveguides 202, which heats the wet colorants applied to print medium 112 while print medium 112 is within waveguides 202. As shown, a plurality of waveguides 202 are positioned adjacent to each other lengthwise. Waveguides 202 on the ends across the width of print medium 112 are not shown in FIG. 2A for illustrative purposes.

Figure 2B:
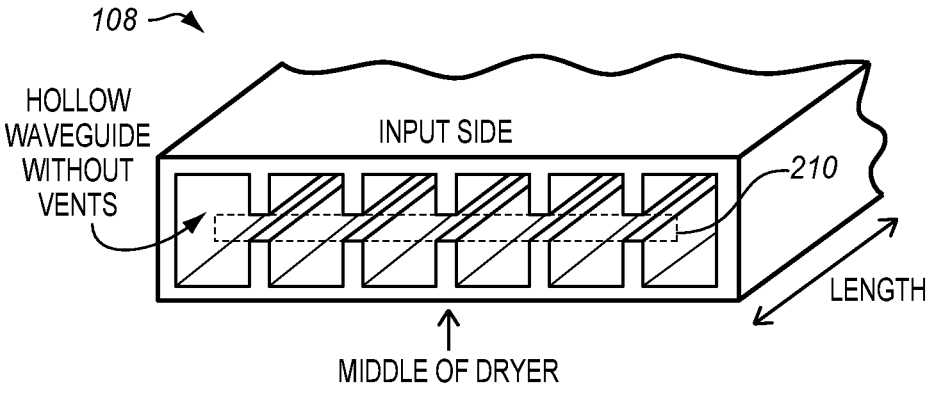
FIG. 2B is an end view of the microwave dryer of FIG. 2A in an exemplary embodiment.
Figure 2C:
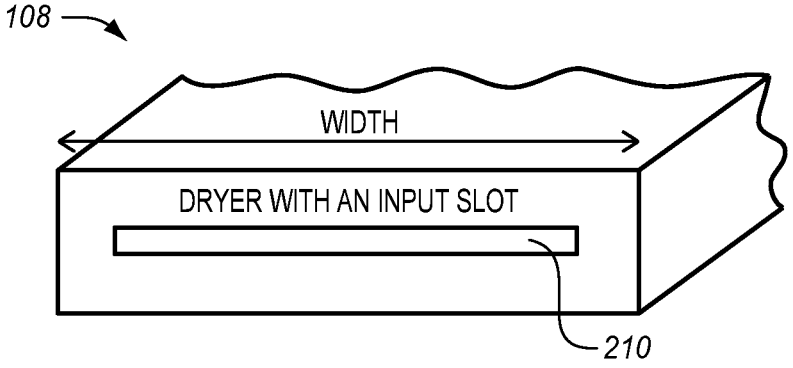
FIG. 2C is another end view of the microwave dryer of FIG. 2A in an exemplary embodiment.

In this embodiment, an input slot 210 at a first end 212 of waveguides 202 is sized to accept print medium 112, and to pass print medium 112 into waveguides 202. For example, input slot 210 may be sized to have about same width as print medium 112, and a height that varies depending on the frequency of electromagnetic energy 114. When microwave source 204 operates at 2.4 Gigahertz, input slot 210 may have a height that is about 1 to 1.5 centimeters. In this embodiment, an output slot 211 at a second end 214 of waveguides 202 is sized to accept print medium 112, and to pass print medium 112 out of waveguides 202. A passageway 226 extends through waveguides 202 between input slot 210 and output slot 211. Passageway 226 is sized to accept print medium 112, and to allow print medium 112 to traverse through microwave dryer 108 and at least one of waveguides 202. The number of waveguides 202 is selected to accommodate a width of passageway 226 such that the outer side walls of microwave dryer 108 do not include passageway 226. FIG. 2B and FIG. 2C are end views of microwave dryer 108 of FIG. 2A in an exemplary embodiment, and illustrate input slot 210. FIG. 2B illustrates waveguides 202 located on the ends across the width of print medium 112.

In some embodiments, waveguides 202 may include vents 222 in a top surface 223 and bottom surface 224 of waveguides 202, which can be used to provide airflow through the interiors of waveguides 202.

In some embodiments, microwave dryer 108 may include a plurality of guides 208 that are disposed within waveguides. Guides 208 are illustrated as circular in FIG. 2A, although guides 208 may be other shapes as desired. Guides 208 are in contact with print medium 112 within waveguides 202, and may be used to prevent print medium 112 from fluttering and/or contacting the interior surfaces of waveguides 202. Contact between print medium 112 and the interior surfaces of waveguides 202 is undesirable, as it may smear or smudge the wet colorants applied to print medium 112 or cause physical damage to print medium 112. In this embodiment, guides 208 are in contact with print medium 112 on a side of print medium 112 (e.g., a bottom side 216) that does not include the wet colorant. For instance, the wet colorant may be applied to a top side 218 of print medium 112. Guides 208 may include rods (e.g., glass rods), rollers (e.g., TEFLON™ rollers), or combinations of rods or rollers.

Further, guides 208 may be formed from materials that are transparent to electromagnetic energy 114. This ensures that guides 208 are not heated by electromagnetic energy 114.

In a typical print medium microwave dryer, a print medium traverses a passageway of a waveguide once, and exits the microwave dryer. However, in this embodiment, print medium 112 enters input slot 210 of waveguides 202, traverses through the interior of waveguides 202 via passageway 226, and exits an output slot 211 of waveguides 202. Print medium 112 contacts a roller 206 at second end 214 of waveguides 202, which turns, re-directs, and/or reverses print medium 112 back through passageway 226 to input slot 210. This increases the exposure time of print medium 112 to electromagnetic energy 114 within waveguides 202. In this embodiment, roller 206 contacts print medium 112 on a side of print medium 112 (e.g., bottom side 216) that does not include the wet colorant.

In some embodiments, roller 206 may be metal to reduce an amount of electromagnetic energy 114 that is emitted from output slot 211. Roller 206 may also be heated in some embodiments to facilitate drying of the wet colorants applied to print medium 112, or to least reduce the cooling of print medium 112 at roller 206.

In some embodiments, roller 206 may be disposed within output slot 211 at second end 214 of waveguides 202, as illustrated in FIG. 2A. However, in other embodiments, roller 206 may be located outside of output slot 211 at second end 206 as desired.

Figure 3:
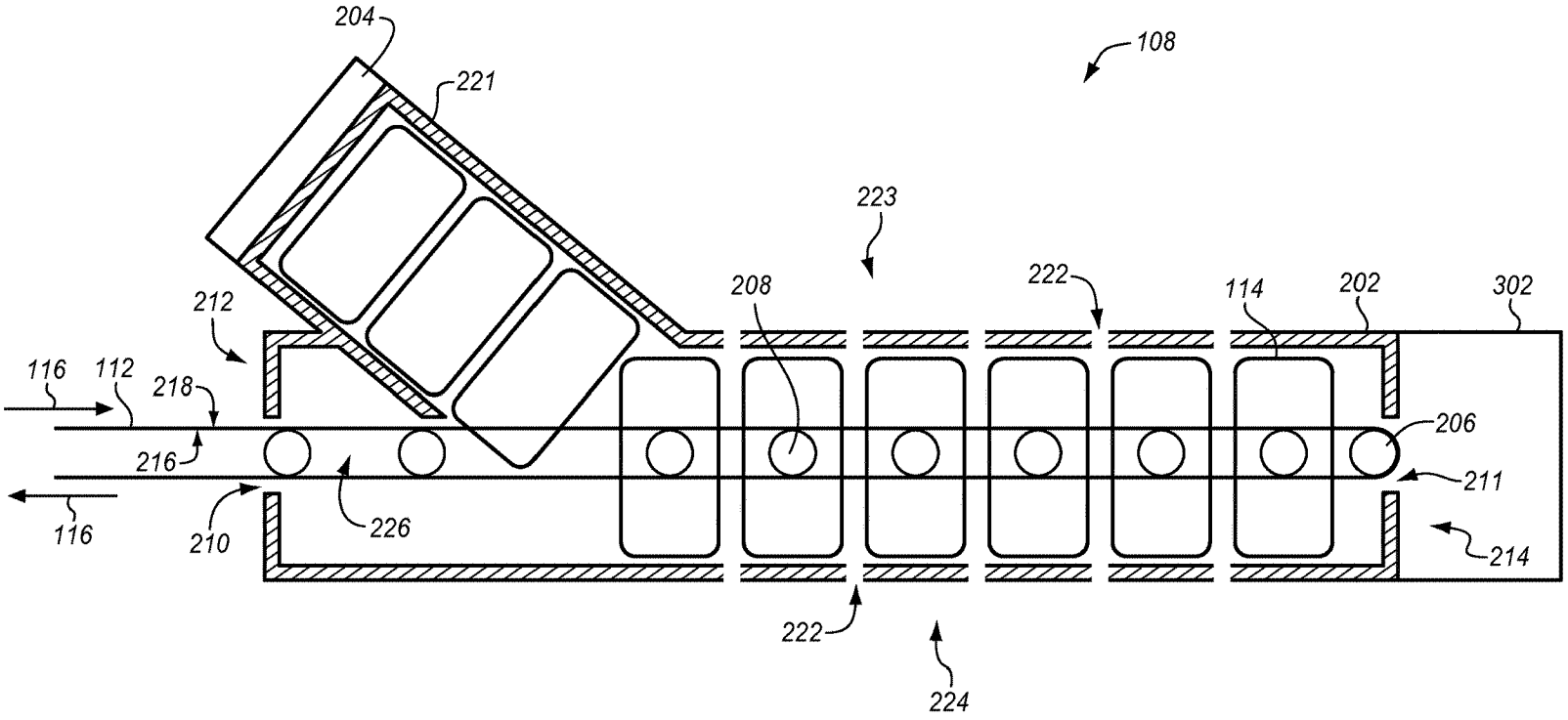
FIG. 3 is a cross-section of one of the waveguides of the microwave dryer of FIG. 2A in an exemplary embodiment.

FIG. 3 is a cross-section of one of the waveguides of FIG. 2A in an exemplary embodiment. In this embodiment, waveguides 202 includes a metal cover 302. Metal cover 302 encapsulates roller 206 and is used to prevent the emission of electromagnetic energy 114 from output slot 211 of waveguides 202. In addition, cover 302 reflects microwave energy back towards roller 206 and continues to electromagnetically dry the ink as the print medium propagates around roller 206, especially when roller 206 extends beyond the output slot 211, and is a highly desirable feature. In this embodiment, roller 206 is within waveguide 202 and proximate to output slot 211. Print medium 112 is received by microwave dryer 108 input slot 210 of waveguide 202, where guides 208 direct print medium 112 along media path 116 through passageway 226 to roller 206 at second end 214. Roller 206 redirects print medium 112 at second end 214 back through passageway 226 along guides 208 towards input slot 210 at first end 212. This dual-pass configuration for print medium 112 through waveguide 202 increases the exposure time of print medium 112 to electromagnetic energy 114 as compared to utilizing a single-pass through waveguide 202, thereby improving the drying performance of microwave dryer 108.

Figure 4:
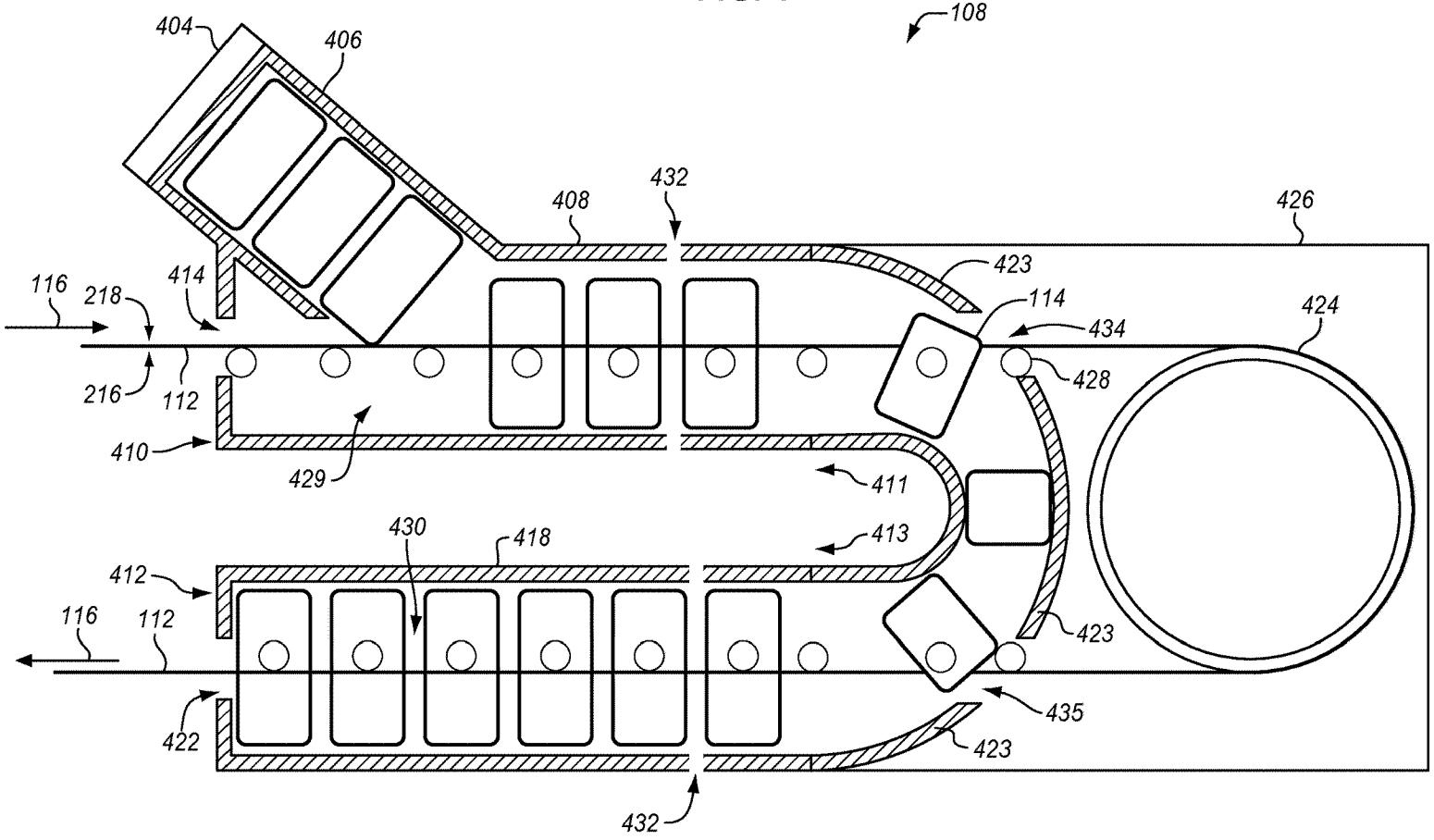
FIG. 4 is a cross-section of one of the waveguides of another microwave dryer in an exemplary embodiment.

FIG. 4 is a cross-section of one of the waveguides of microwave dryer 108 in another exemplary embodiment. In this embodiment, microwave dryer 108 includes a first microwave waveguide 408 that is electromagnetically coupled to a microwave source 404 (e.g., a 2.4 Gigahertz microwave source) via coupler 406. First microwave waveguide 408 is configured to transport electromagnetic energy 114 generated by microwave source 404 between a first end 410 and a second end 411 of first microwave waveguide 408. First microwave waveguide 408 includes an input slot 414 that receives print medium 112, and a first passageway 429 between first end 410 and second end 411. Input slot 414 and first passageway 429 are sized to pass print medium 112 through first microwave waveguide 408.

Microwave dryer 108 further includes a second microwave waveguide 418 that is configured to transport electromagnetic energy 114 between a third end 413 and a fourth end 412 of second microwave waveguide 418. Second microwave waveguide 418 includes an output slot 422 that discharges print medium 112, and a second passageway 430 between third end 413 and fourth end 412. Output slot 422 and second passageway 430 are sized to pass print medium 112 through second microwave waveguide 418.

In some embodiments, first microwave waveguide 408 and/or second microwave waveguide 418 may include vents 432 that are used to provide an air flow into and/or out of first microwave waveguide 408 and/or second microwave waveguide 418.

Microwave dryer 108 further includes a bend coupler 423 (e.g., an h-bend coupler) that is proximate to second end 411 of first microwave waveguide 408 and third end 413 of second microwave waveguide 418. Bend coupler 423 is configured to redirect electromagnetic energy 114 from first microwave waveguide 408 to second microwave waveguide 418. Although first microwave waveguide 408, second microwave waveguide 418, and bend coupler 423 are illustrated in a horizontal configuration in FIG. 4, first microwave waveguide 408, second microwave waveguide 418, and bend coupler 423 may be oriented vertically to further reduce a horizontal footprint of microwave dryer 108. In this embodiment, electromagnetic energy 114 within first microwave waveguide 408 and second microwave waveguide 418 heats the wet colorants applied to print medium 112 while print medium 112 is within first microwave waveguide 408 and second microwave waveguide 418.

In this embodiment, bend coupler 423 includes passages 434-435 that are sized to pass print medium 112 from first passageway 429 of first microwave waveguide 408 to second passageway 430 of second microwave waveguide 418. In particular, passage 434 is aligned with first passageway 429, and passage 435 is aligned with second passageway 430.

In some embodiments, microwave dryer 108 includes a plurality of guides 428 that are disposed within first microwave waveguide 408 and second microwave waveguide 418. Guides 428 are illustrated as circular in FIG. 4, although guides 428 may be other shapes as desired. Guides 428 direct print medium 112 within the interior boundaries of first microwave waveguide 408 and second microwave waveguide 418, and may be used to prevent print medium 112 from fluttering and/or contacting the interior surfaces of first microwave waveguide 408 and second microwave waveguide 418. Contact between print medium 112 and the interior boundaries of first microwave waveguide 408 and second microwave waveguide 418 is undesirable, as it may smear or smudge the wet colorants applied to print medium 112 or may cause physical damage to print medium 112. In this embodiment, guides 428 contact print medium 112 on a side of print medium 112 (e.g., a bottom side 216) that does not include the wet colorant. For instance, the wet colorant may be applied to top side 218 of print medium 112 instead. Guides 428 in FIG. 4 may be similar in construction and materials to guides 208 previously described with respect to FIGS. 2A, 2B, 2C, and 3.

In this embodiment, print medium 112 enters input slot 414, traverses through first passageway 429 of first microwave waveguide 408, exits passage 434 of bend coupler 423, and contacts a roller 424 proximate to passages 434-435 of bend coupler 423. Roller 424 turns or re-directs print medium 112 through passage 435 of bend coupler 423 to second passageway 430 of second microwave waveguide 418. The diameter of roller 424 can be adjusted to change the tension between the print medium and guides 428. For example, when the diameter of roller 424 is reduced, the trajectory of the print medium from output slot 434 to slot 435 is changed from a U shape to a V shape. V-shaped trajectories will provide greater tension between the print medium and guides 428, and will be required when the speed of the print medium is increased to values that cause the print medium to flutter within the passageway for the print medium that is inside the waveguides. Print medium 112 passes through second passageway 430 of second microwave waveguide 418, and exits output slot 422.

In some embodiments, an equal plurality of first microwave waveguide 408, second microwave waveguide 418, and bend coupler 423 may be positioned adjacent to each other lengthwise as previously described with respect to FIGS. 2A, 2B,2C, and 3, and operate in the manner previously described.

In some embodiments, roller 424 may be metal to reduce an amount of electromagnetic energy 114 that is emitted from passages 434-435 of bend coupler 423. Roller 424 may also be heated in some embodiments to facilitate drying of the wet colorants applied to print medium 112, or to at least reduce the cooling of print medium 112 at roller 424. Roller 424 contacts print medium 112 on side of print medium 112 (e.g., a bottom side 216) that does not include the wet colorant.

In some embodiment, a metal cover 426 may encapsulate roller 424 and bend coupler 423, which is used to prevent the emission of electromagnetic energy 114 from passages 434-435 of bend coupler 423. In addition, cover 426 reflects microwave energy back towards roller 424 and continues to electromagnetically dry the ink as the print medium propagates around roller 424, and is a highly desirable feature of cover 426.

Although specific embodiments were described herein, the scope of the invention is not limited to those specific embodiments. The scope of the invention is defined by the following claims and any equivalents thereof.

What is claimed is:

1. A microwave dryer configured to dry a wet colorant applied to a continuous-form print medium by a printing system, the microwave dryer comprising:

a microwave source configured to generate electromagnetic energy to dry the wet colorant;

a microwave waveguide coupled to the microwave source and configured to transport the electromagnetic energy between a first end and a second end of the microwave waveguide, wherein the first end and the second end of the microwave waveguide are separated from each other by a long axis of the microwave waveguide, wherein the microwave waveguide includes a passageway that receives the continuous-form print medium at the first end and is sized to pass the continuous-form print medium through the microwave waveguide to the second end; and a roller that is proximate to the second end and configured to receive the continuous-form print medium from the passageway, and to re-direct the continuous-form print medium back through the passageway to the first end.

2. The microwave dryer of claim 1, further comprising:

a plurality of guides disposed within the microwave waveguide that are configured to contact the continuous-form print medium on a side of the continuous-form print medium that does not include the wet colorant.

3. The microwave dryer of claim 2, wherein:

the plurality of guides comprises rods, rollers, or combinations of the rods and the rollers.

4. The microwave dryer of claim 2, wherein:

the plurality of guides comprises a material that is transparent to the electromagnetic energy of the microwave source.

5. The microwave dryer of claim 1, wherein:

the roller comprises metal to mitigate a leakage of the electromagnetic energy from the microwave waveguide at the second end.

6. The microwave dryer of claim 1, further comprising:

a metal cover proximate to the second end that encapsulates the roller and prevents emission of the electromagnetic energy from the microwave waveguide.

7. The microwave dryer of claim 1, wherein:

the roller is within the microwave waveguide.

8. A microwave dryer configured to dry a wet colorant applied to a continuous-form print medium by a printing system, the microwave dryer comprising:

a microwave source configured to generate electromagnetic energy to dry the wet colorant;

a first microwave waveguide coupled to the microwave source and configured to transport the electromagnetic energy between a first end and a second end of the first microwave waveguide, wherein the first end and the second end of the first microwave waveguide are separated from each other by a long axis of the first microwave waveguide, wherein the first microwave waveguide includes a first passageway that receives the continuous-form print medium at the first end and is sized to pass the continuous-form print medium through the first microwave waveguide to the second end;

a second microwave waveguide configured to transport the electromagnetic energy between a third end and a fourth end of the second microwave waveguide, wherein the third end and the fourth end of the second microwave waveguide are separated from each other by a long axis of the second microwave waveguide, wherein the second microwave waveguide includes a second passageway that receives the continuous-form print medium at the third end and is sized to pass the continuous-form print medium through the second microwave waveguide to the fourth end;

a bend coupler that is proximate to the second end of the first microwave waveguide and the third end of the second microwave waveguide that is configured to redirect the electromagnetic energy from the first microwave waveguide to the second microwave waveguide, wherein the bend coupler includes passages that are sized to pass the continuous-form print medium from the first passageway to the second passageway; and a roller that is proximate to the passages of the bend coupler that is configured to redirect the continuous-form print medium from the first passageway of the first microwave waveguide to the second passageway of the second microwave waveguide.

9. The microwave dryer of claim 8, further comprising:

a plurality of guides disposed within the first and second microwave waveguides configured to contact the continuous-form print medium on a side of the continuous-form print medium that does not include the wet colorant.

10. The microwave dryer of claim 9, wherein:

the plurality of guides comprises rods, rollers, or combinations of the rods and the rollers.

11. The microwave dryer of claim 10, wherein:

the plurality of guides comprises a material that is transparent to the electromagnetic energy of the microwave source.

12. The microwave dryer of claim 8, wherein:

the roller comprises metal to mitigate a leakage of the electromagnetic energy from the passages.

13. The microwave dryer of claim 8, further comprising:

a metal cover that encapsulates the roller and prevents emission of the electromagnetic energy from the passages.

14. A printing system, comprising:

a printer configured to apply a wet colorant onto a continuous-form print medium; and a microwave dryer configured to receive the continuous-form print medium from the printer, the microwave dryer comprising:

a microwave source configured to generate electromagnetic energy to dry the wet colorant; and a microwave waveguide coupled to the microwave source and configured to transport the electromagnetic energy between a first end and a second end of the microwave waveguide, wherein the first end and the second end of the microwave waveguide are separated from each other by a long axis of the microwave waveguide, wherein the microwave waveguide includes a passageway that receives the continuous-form print medium at the first end and is sized to pass the continuous-form print medium through the microwave waveguide to the second end; and a roller that is proximate to the second end and configured to receive the continuous-form print medium from the passageway, and to re-direct the continuous-form print medium back through the passageway to the first end.

15. The printing system of claim 14, wherein the microwave dryer further comprises:

a plurality of guides disposed within the microwave waveguide that are configured to contact the continuous-form print medium on a side of the continuous-form print medium that does not include the wet colorant.

16. The printing system of claim 15, wherein:

the plurality of guides comprises rods, rollers, or combinations of the rods and the rollers.

17. The printing system of claim 15, wherein:

the plurality of guides comprises a material that is transparent to the electromagnetic energy of the microwave source.

18. The printing system of claim 14, wherein:

the roller comprises metal to mitigate a leakage of the electromagnetic energy from the microwave waveguide at the second end.

19. The printing system of claim 14, wherein the microwave dryer further comprises:

a metal cover proximate to the second end that encapsulates the roller and prevents emission of the electromagnetic energy from the microwave waveguide.

20. The printing system of claim 14, wherein:

the roller is within the microwave waveguide.

* * * * *